United States Patent [19]

Mizuguchi et al.

[11] Patent Number: 4,796,509

[45] Date of Patent: Jan. 10, 1989

[54] ELECTRONIC TUNING APPARATUS

[75] Inventors: Masaaki Mizuguchi; Hirohisa Kuroyanagi, both of Hamamatsu, Japan

[73] Assignee: Yamaha Corporation, Shizuoka, Japan

[21] Appl. No.: 122,112

[22] Filed: Nov. 18, 1987

[30] Foreign Application Priority Data

Nov. 22, 1986 [JP] Japan ..... 61-279377

[51] Int. Cl.[4] ..... G10G 7/02

[52] U.S. Cl. ..... 84/454

[58] Field of Search ..... 84/454, 477 R, 478 R, 84/DIG. 18

[56] References Cited

U.S. PATENT DOCUMENTS 4,018,124 4/1977 Rosado ..... 84/454 X

*Primary Examiner*—W. B. Perkey

*Attorney, Agent, or Firm*—Koda and Androlia

[57] ABSTRACT

An electronic tuning apparatus is constructed of an input device for inputting a tone signal to be measured, a signal generating circuit for generating a plurality of reference frequency signals, respectively, corresponding to a plurality of tone names independently for each tone name, a plurality of display devices, respectively, corresponding to a plurality of tone names and a plurality of display control devices, respectively, corresponding to a plurality of tone names. To the signal generating circuit, a scale selecting switch and a pitch adjustor are connected. Each display control device is constructed so as to display an agreement of the frequency of said tone name at a predetermined octave with the frequency of said input tone signal in the display device corresponding to said tone name. The display is realized by an on-off arrangement pattern composed of a plurality of turned-on luminous elements and a plurality of turned-off luminous elements. According to the electronic tuning apparatus of the present invention, it is not necessary to take a lot of time and labor for changing-over an octave and a tone name and, as the measurement results are displayed at once after a tone to be measured is inputted, a tuning for each tone name can be performed easily and quickly. Furthermore, a tuning, based on the equal temperament scale and the just intonation scale, is possible.

14 Claims, 9 Drawing Sheets

| | EQUAL TEMPORAMENT | JUST INTONATION |
|---|---|---|
| C | 0 1 0 1 1 - - - - - 0 | 0 1 0 1 0 - - - - - - 0 |
| C# | 0 1 0 1 1 - - - - - 1 | 0 1 0 1 0 - - - - - - 1 |
| D | 0 1 1 - - - - - - - 0 | 0 1 1 - - - - - - - - 1 |
| - - - | - - - | - - - |
| B | 1 1 0 - - - - - - - 0 | 1 1 0 - - - - - - - - 1 |

ELECTRONIC TUNING APPARATUS

BACKGROUND OF THE INVENTION (a) Field of the invention

The present invention relates to an electronic tuning apparatus to be appropriately used for tuning various musical instruments, for example, such as a wood instrument, a brass instrument, a string instrument and a percussion instrument etc. on the basis of the scale according to the equal temperament and the scale according to any temperament other than the equal temperament.

(b) Description of the prior art

A tuning apparatus for a musical instrument, which is proposed in a prior art, is generally based on the equal temperament scale and, generally classified, an electronic type and a mechanical type are known for it.

As to an electronic tuning apparatus, such an apparatus is known, which is capable of displaying an agreement of frequency between a reference frequency signal and a tone signal to be tuned in a single display, while a reference frequency signal corresponding to a specified pitch is generated by designating an octave and a tone name with a switch etc.

Further, as to a mechanical tuning apparatus, such an apparatus is known, which is capable of displaying a stationary stroboscopic pattern for each tone name in the corresponding display window at the moment of tuning by making twelve stroboscopic pattern discs rotate at a number of revolution corresponding to the equal temperament through a gear mechanism by a synchronous motor driven by an output of a quartz oscillator, while twelve display windows are provided on a panel corresponding to twelve tone names, twelve stroboscopic pattern discs are arranged rotatably at the backside of the panel corresponding to each of the display windows and luminous elements, which turn on and off corresponding to the frequency of a tone to be measured, are provided.

In the above-mentioned electronic tuning apparatus, there is a problem that it takes a lot of time and labor for changing-over an octave and a tone name by a switch etc. when tuning is performed by changing an octave and a tone name successively and it takes a lot of time until a display of the above-mentioned agreement is performed because it takes time for the measurement of an input signal and the calculation of the average period of an input signal even if a tone signal to be measured is inputted at the same time with the change-over.

On the other hand, in the above-mentioned mechanical tuning apparatus, there is not such an above-mentioned problem as found in the electronic tuning apparatus because display sections for twelve tone names are always ready for displaying the tuning, but there is a problem that it can not respond to a scale other than the equal temperament (for example, just intonation) unless a gear ratio of a gear mechanism is changed and further that it is heavy-weighted, large-sized, inconvenient for handling and expensive due to mechanical type.

SUMMARY OF THE INVENTION

The primary object of the present invention is to provide an electronic tuning apparatus which can perform a tuning of each tone name easily and quickly under the consideration of the above-mentioned reasons.

The tuning apparatus according to the present invention comprises input means for inputting a tone signal to be measured, signal generating means for generating a plurality of reference frequency signals, respectively, corresponding to a plurality of tone names independently for each tone, a plurality of display means, respectively, corresponding to a plurality of tone names and a plurality of display control means, respectively, corresponding to a plurality of tone names. Each of display control means is constructed so as to display an agreement of the frequency of said tone name at a predetermined octave with the frequency of said input tone signal in the display means corresponding to said tone name on the basis of the reference frequency signal of the corresponding tone name from signal generating means and the input tone signal from the input means.

As a reference frequency signal can be generated independently for each tone name according to the present invention, it is easy to reset each frequency according to a scale other than the equal temperament scale even if frequencies of a plurality of reference frequency signals are preset according to the equal temperament scale. Further, as a display of a tuning is made possible for each of display means by providing respective display means for a plurality of tone names, it is not necessary to changeover octave and tone name so that the time required for displaying the measurement results, after a tone signal to be measured is inputted, is remarkably shortened.

In the above described constitution of the present invention, each of display means may be constructed of a group of luminous elements and further each of display control means may be constructed so that, by driving the group of luminous elements corresponding to the tone name on the basis of the reference frequency signal of the corresponding tone name from the signal generating means and an input tone signal from input means, an on-off arrangement pattern composed of turned-on luminous elements and turned-off luminous elements is differently displayed from each other between the case of the agreement of the frequency of the input tone signal with the frequency of said tone name at a certain octave and the case of the agreement with the frequency of said tone name at another octave. In such a way it is capable of displaying the tuning of a plurality of octaves by each group of luminous elements so that the number of the groups of luminous elements can be made smaller than the case wherein a group of the luminous elements is provided for each octave.

Furthermore, due to the construction mainly composed of an electronic circuit, the tuning apparatus of the present invention is compact, light-weighted and easy for handling and additionally it can be manufactured at low cost.

The above and other objects, features and advantages of the present invention will become more apparent from the following description when taken in conjunction with the accompanying drawings in which a preferred embodiment of the present invention is shown by way of illustrative example.

DESCRIPTION OF THE PREFERRED EMBODIMENT

Figures 1, 2:
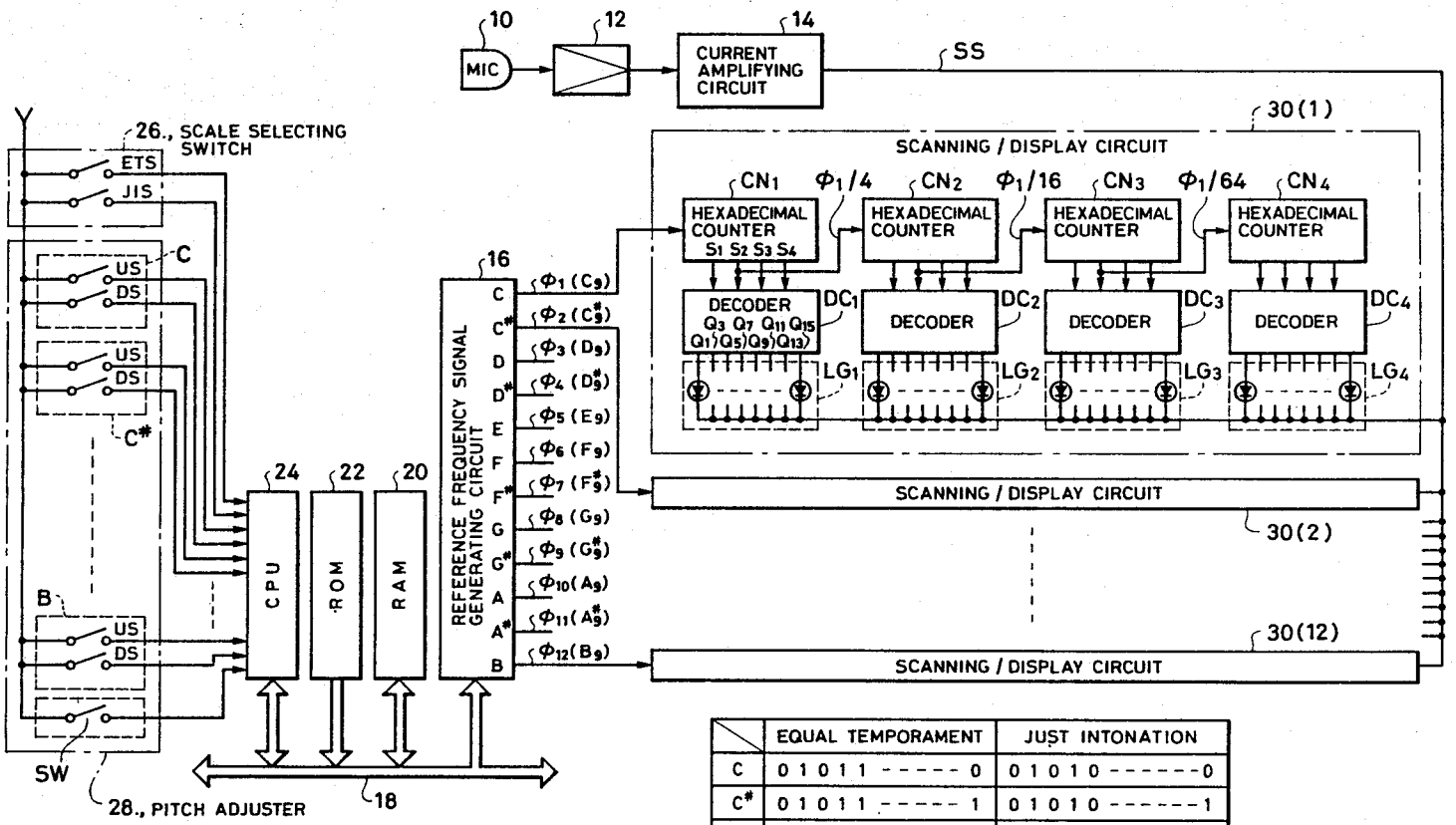
FIG. 1 is a block diagram showing a circuit composition of a tuning apparatus according to an embodiment of the present invention.
FIG. 2 is an example of a scale information table to be stored in ROM shown in FIG. 1.

FIG. 1 shows a circuit composition of a tuning apparatus according to an embodiment of the present invention.

Circuit composition (FIG. 1)

A microphone (MIC) 10 serves to input a tone signal to be measured from a musical instrument etc. to be tuned and an inputted tone signal is supplied to a current amplifying circuit 14 through an input amplifier 12. The current amplifying circuit 14 is provided for driving the below-mentioned luminous elements to be turned on and off and output a current-amplified tone signal SS.

In this embodiment, a fundamental wave detecting circuit for detecting a fundamental wave from an input tone signal and a waveform shaping circuit for converting an input tone signal into a square wave are not provided. The reason why a fundamental wave detecting circuit is not provided is that it is considered that in a brass instrument a pitch is determined by a harmonic component and the reason why a wave shaping circuit is not provided is that the wave shaping circuit disturbs a quick display by acting as a delay circuit. The fundamental wave detecting circuit and the waveform shaping circuit may be provided according to a necessity.

A reference frequency signal generating circuit 16 is composed of twelve tone generators which generate reference frequency signals of $\phi_1, \phi_2, \ldots, \phi_{12}$ corresponding to twelve tone names of C, C# . . . , B independently for each tone name. In this case, the term "independently for each tone name" means that even if the frequency of a signal $\phi_1$, for example, is changed, the frequency of other signals such as $\phi_2$ etc. does not change. Therefore, a typical example of the circuit 16 comprises twelve pulse oscillators in which each oscillation frequency can be preset variably. To this circuit 16 through a bus 18 are connected a random access memory (RAM) 20, a read-only memory (ROM) 22 and a central processing unit (CPU) 24. In ROM 22 a scale information table, for example, as shown in FIG. 2 is stored.

Although, as for a scale selecting switch 26, an equal temperament scale selecting switch ETS and a just intonation scale selecting switch JIS are provided, switches for selecting other scales such as Pythagorean scale etc. may be provided as occasion arises. When the equal temperament scale selecting switch ETS is switched on, CPU 24 reads scale information data as shown in the column of "EQUAL TEMPERAMENT" in FIG. 2 from ROM 22 and transfers it to a reference frequency signal generating circuit 16. From the reference frequency signal generating circuit 16 are generated, as an example, reference frequency signals $\phi_1, \phi_2, \ldots, \phi_{12}$ having frequencies corresponding to each tone name of $C_9, C_9^{\#}, \ldots, B_9$. On the other hand, when the just intonation scale selecting switch JIS is switched on, in accordance with the same procedure as mentioned above, frequencies of the reference frequency signals $\phi_1, \phi_2, \ldots, \phi_{12}$ are preset according to the just intonation scale.

In order to be capable of adjusting the pitch of each tone name independently, a pitch adjustor 28 has a pitch-up switch US and a pitch-down switch DS corresponding to each of twelve tone names of C, C#, . . . , B. A pitch control according to the manipulation of these switches US, DS is capable only when a pitch adjusting switch SW is switched on. That is to say, when the pitch-up switch US or the pitch-down switch DS is manipulated for each tone name under the on-state of the pitch adjusting switch SW, correspondingly the corresponding data stored in ROM 22 is stored into RAM 20 after being adjusted. Each adjusted value is read from RAM 20 by CPU 24 and supplied to the reference frequency signal generating circuit 16 in order to control the frequency of reference frequency signals $\phi_1 \sim \phi_{12}$ independently for each tone name. Therefore, by manipulating the pitch-up switch US or the pitch-down switch DS of the tone name C, for example, correspondingly the frequency of the reference frequency signal $\phi_1$ is preset independently higher or lower than the reference value. When the pitch adjusting switch SW is switched off, the data of ROM 22 are used irrespective of the data of RAM 20.

Scanning/display circuits 30(1)~30(12), which receive the reference frequency signals $\phi_1 \sim \phi_{12}$ respectively and all of which receive a tone signal at the same time, are constructed so as to display a tuning in a plurality of the groups of luminous elements on the basis of the signal received, respectively, in each circuit. As these circuits 30(1)~30(12) have the same composition and operate in a similar way, the composition and the operation of a circuit 30(1) will be described below by way of example.

In the circuit 30(1), four hexadecimal counters $CN_1 \sim CN_4$, four decoders $DC_1 \sim DC_4$ and four groups of luminous elements $LG_1 \sim LG_4$ are provided.

To the counter $CN_1$ a reference frequency signal $\phi_1$ is supplied as an input to be countered, to a counter $CN_2$ a frequency divided output $\phi_1/4$, having a frequency of $\frac{1}{4}$ of the signal $\phi_1$, is supplied as an input to be countered from the counter $CN_1$, to a counter $CN_3$ a frequency divided output $\phi_1/16$, having a frequency of 1/16 of the signal $\phi_1$, is supplied as an input to be countered from the counter $CN_2$ and to a counter $CN_4$ a frequency divided output $\phi_1/64$, having a frequency of 1/64 of the signal $\phi_1$, is supplied as an input to be countered from the counter $CN_3$.

Decoders $DC_1 \sim DC_4$ are provided so as to decode the count output (code output composed of 4 bits $S_1 \sim S_4$) from each counter of $CN_1 \sim CN_4$. It is disposed such that groups of luminous elements $LG_1 \sim LG_4$ are connected to the output side of the decoders $DC_1 \sim DC_4$, respectively, and, as shown in the decoder $DC_1$ of FIG. 1, eight luminous elements (light emitting diode, for example) of the group of luminous elements corresponding to the said decoder are driven, respectively, from the anode side by the odd-numbered outputs $Q_1, Q_3, \ldots, Q_{15}$ of outputs $Q_0 \sim Q_{15}$ for each decoder.

All luminous elements belonging to the groups of luminous elements $CN_1 \sim CN_4$ are driven from the cathode side by a tone signal. Each luminous element emits light when a driving current exceeds a predetermined level.

Figure 3:
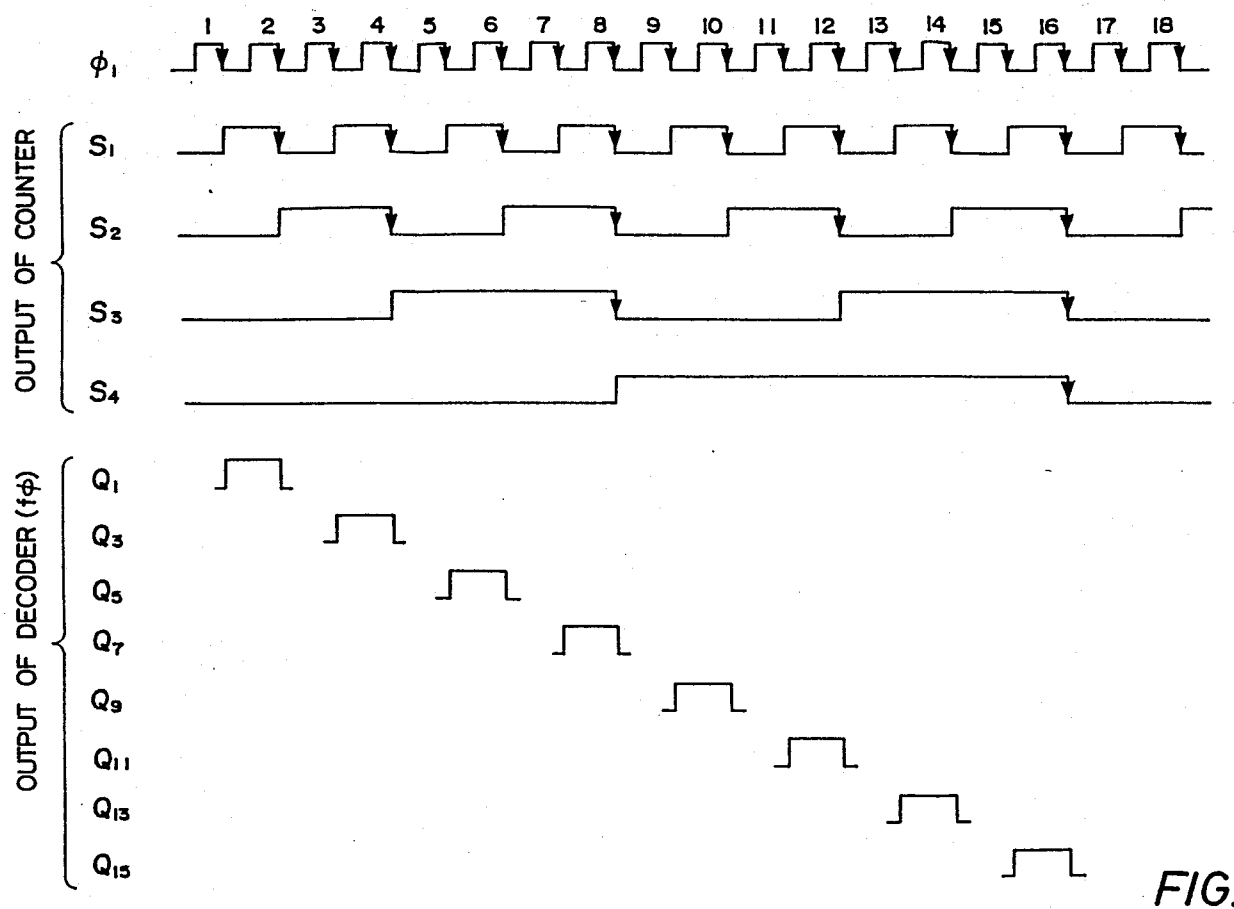
FIG. 3 is a signal waveform for explaining the operation of a counter/decoder section in a tuning apparatus shown in FIG. 1.

Operation of counter/decoder section (FIG. 3)

Then, referred to FIG. 3, the operation of the counter/decoder section will be described below according to the counter $CN_1$ and the decoder $DC_1$ by way of example.

The counter $CN_1$ generates frequency divided outputs $S_1, S_2, S_3, S_4$, respectively, corresponding to $\frac{1}{2}, \frac{1}{4}, \frac{1}{8}$, 1/16 of the frequency of the signal $\phi_1$ by counting the pulse of the reference frequency signal $\phi_1$ successively from the first one. These reference frequency outputs are supplied to the decoder $DC_1$ as a count output of counter circuit and then decoded. As a result, from the decoder $DC_1$ the output signals $Q_1, Q_3, Q_5, \ldots Q_{15}$ are successively generated corresponding to the count value of 1, 3, 5, . . . , 15 of the counter $CN_1$.

The count value of the counter $CN_1$ is reset to zero synchronously to the down of the 16th pulse of the signal $\phi_1$ and thereafter the operation of generating the output signals of $Q_1 \sim Q_{15}$ is repeated successively in the same way as above-mentioned. Therefore, eight luminous elements of the group of luminous elements $LG_1$ are scanned successively and repeatedly corresponding to output signals $Q_1 \sim Q_{15}$. The scanning frequency $f\phi$ is corresponding to the frequency divided output $S_1$ at this time and therefore if the frequency of the signal $\phi_1$ is corresponding to the tone $C_9$, $f\phi$ corresponds to the tone $C_8$.

Figure 4:
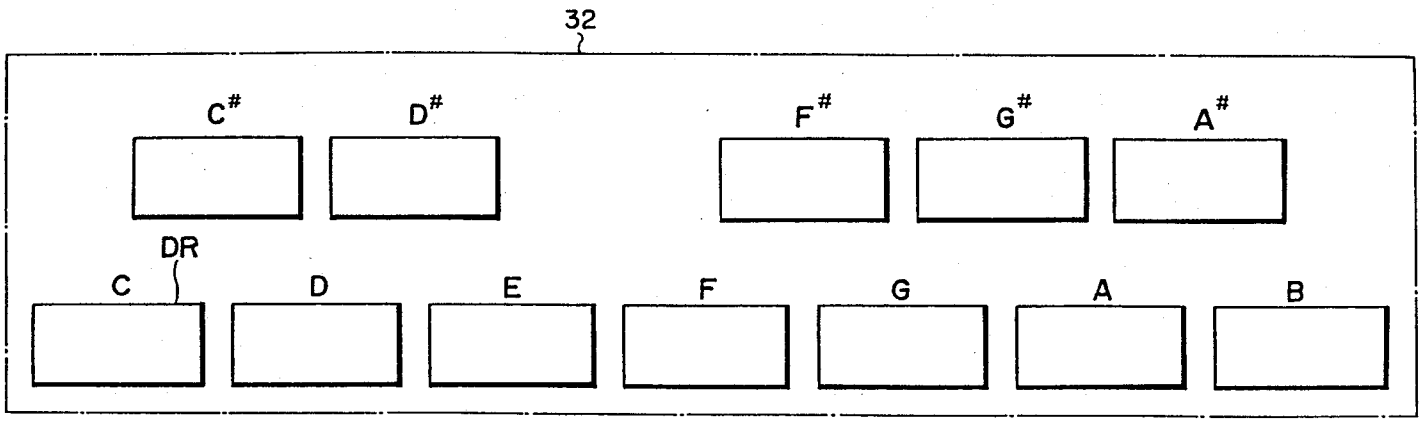
FIG. 4 is a front view of a display panel in a tuning apparatus shown in FIG. 1.

Display panel constitution (FIGS. 4 and 5)

FIG. 4 shows an example of display panel constitution of the above-mentioned tuning apparatus.

Figure 5A:
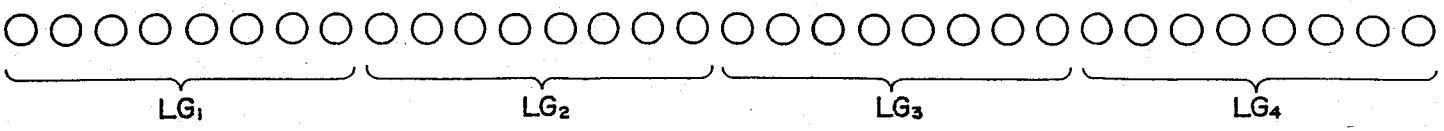
FIGS. 5A to 5C are arrangement diagrams showing different examples of the arrangement of a group of luminous elements acceptable for each display section of the display panel shown in FIG. 4.

In a display panel 32, twelve display sections corresponding to twelve tone names of C, C#, . . . , B are arranged in a similar way as the arrangement of white and black keys on the keyboard and in each display section DR, the groups of luminous elements $LG_1 \sim LG_4$ are arranged in a row, for example, in a right and left direction as shown in FIG. 5A.

Figure 5C:
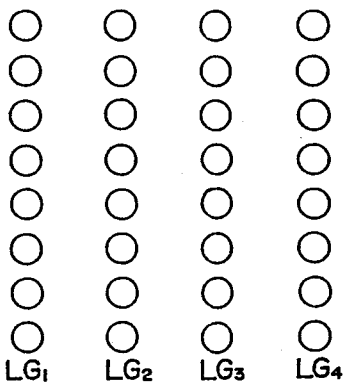
Figure 5B:
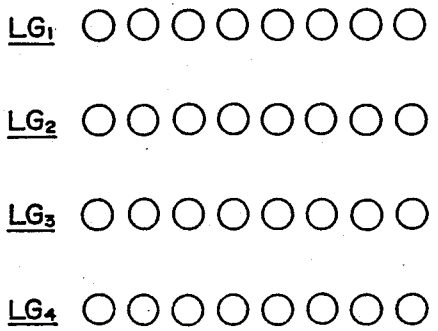

As for the arrangement of the groups of luminous elements in each display section DR, the arrangement of the groups of luminous elements $LG_1 \sim LG_4$ in four rows of a right and left direction as shown in FIG. 5B or the arrangement of the group of luminous elements $LG_1 \sim LG_4$ in four columns of upward and downward direction as shown in FIG. 5C and so on may be adoptable.

Display operation (FIGS. 6 to 10)

FIGS. 6 to 9 show display operations of the group of luminous elements $LG_1$ when the input tone frequency (frequency of tone signal SS) fs has each value of 1, $\frac{1}{2}$, $\frac{1}{4}$ and $\frac{1}{8}$ of the scanning frequency $f\Phi$. In these figures, for the sake of a convenience, the tone signal SS is assumed as a square wave having a frequency corresponding to the input tone and further a hatched circle-mark shows a turned-on luminous element and a non-hatched circle-mark shows a turned-off luminous element.

Figure 6:
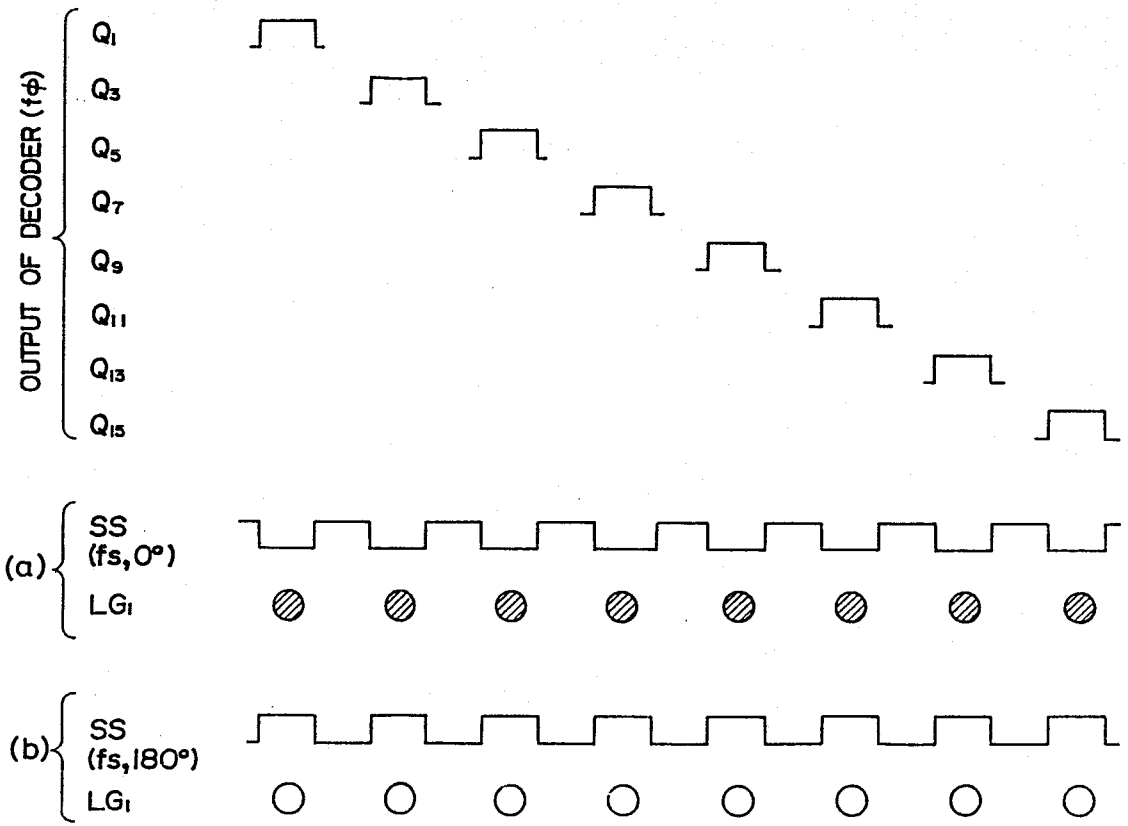
FIGS. 6 to 9 are signal waveform diagrams for explaining display operations performed when an input tone frequency has each value of 1, $\frac{1}{2}$, $\frac{1}{4}$, and $\frac{1}{8}$ of scanning frequency $f\phi$.

FIG. 6 shows a display operation in the case that an input tone frequency fs is equal to a scanning frequency $f\phi$, wherein when the decoder outputs $Q_1, Q_3, Q_5, \ldots, Q_{15}$ take a high level and correspondingly the tone signal SS takes a low level, all of eight luminous elements of the group of luminous elements $LG_1$ are turned on as shown in FIG. 6(*a*). Further, it is assuemd that the tone signal SS has a phase of 0° at this time and on the contrary when the phase of the tone signal is shifted by 180°, all of eight luminous elements are turned off.

Figure 7:
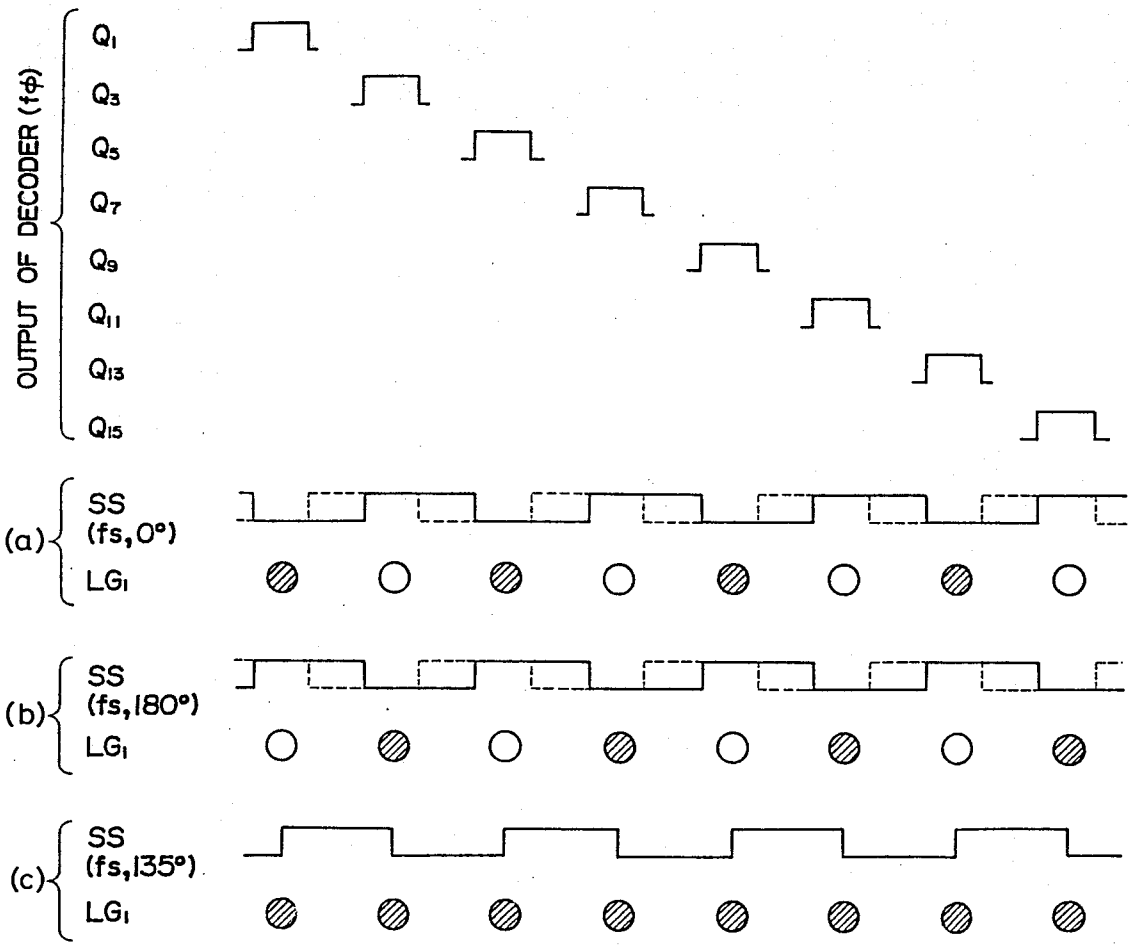

FIG. 7 shows a display operation in the case that the input tone frequency fs is equal to $\frac{1}{2}$ of the scanning fequency $f\phi$, wherein when the decoder outputs $Q_1, Q_5, Q_9, Q_{13}$ take a high level, respectively, and correspondingly the tone signal SS takes a low level, eight luminous elements of the group of luminous elements $LG_1$ are turned on alternately as shown in FIG. 7(*a*). The same arrangement of luminous elements turned on and off are produced as shown by the broken line in FIG. 7(*a*) when the phase of the tone signal SS is shifted by 90° from the waveform of solid line as shown in FIG. 7(*a*).

When the phase of the tone signal SS is shifted by 180° as shown in FIG. 7(*b*) compared to the case as shown in FIG. 7(*a*), eight luminous elements are turned on alternately in a turned-on position different from the position as shown in FIG. 7(*a*). A pattern similar to this is produced when the phase of the tone signal SS is shifted by 90° as shown by the broken line in FIG. 7(*b*) compared to the solid line waveform in FIG. 7(*b*).

When the phase of the tone signal SS is advanced by 135° compared to the case as shown in FIG. 7(*a*), all of eight luminous elements are turned on as shown in FIG. 7(*c*).

Figure 8:
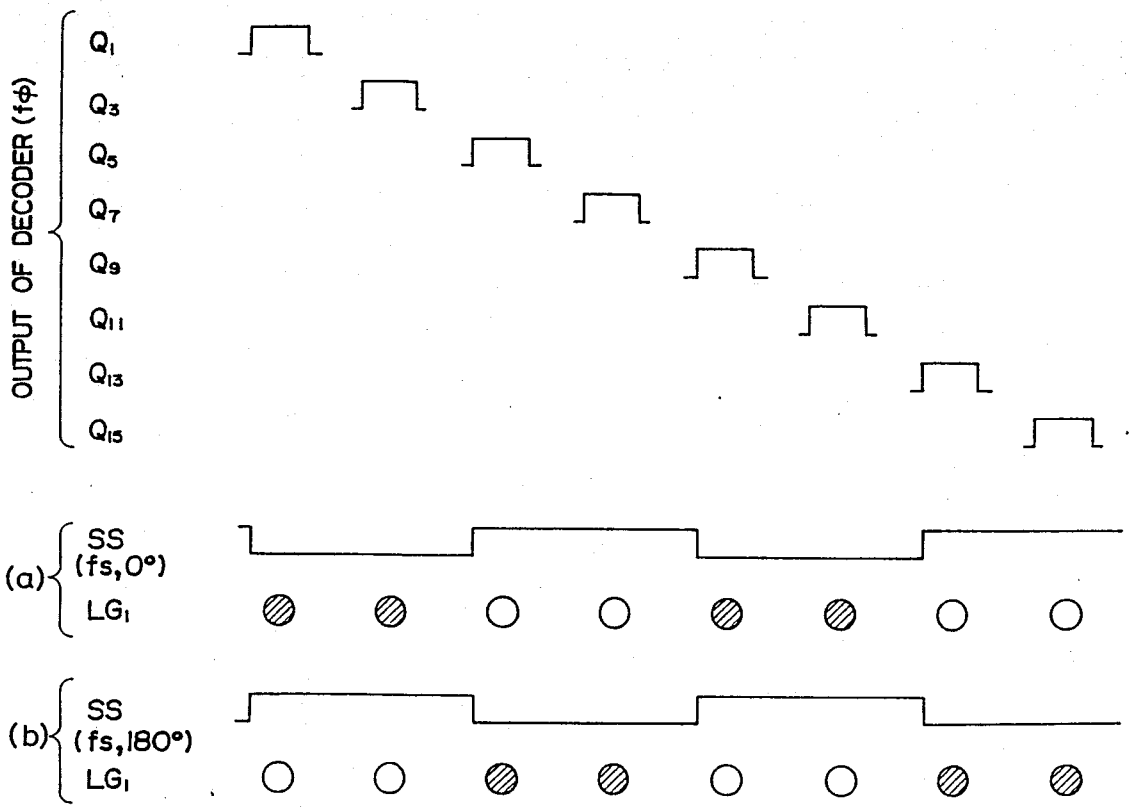

FIG. 8 shows a display operation in the case that the phase of the input tone frequency fs is $\frac{1}{4}$ of the scanning frequency $f\phi$, wherein when the decoder outputs $Q_1, Q_3, Q_9, Q_{11}$ take a high level respectively and correspondingly the tone signal SS takes a low level, eight luminous elements of the group of luminous elements $LG_1$ are turned on by two elements for each four elements as shown in FIG. 8(*a*). When the phase of the tone signal SS is shifted by 180° as shown in FIG. 8(*b*) compared to the case as shown in FIG. 8(*a*), eight luminous elements are turned on by two elements for each four elements of eight luminous elements in a turned-on position different from the position as shown in FIG. 8(*a*).

Figure 9:
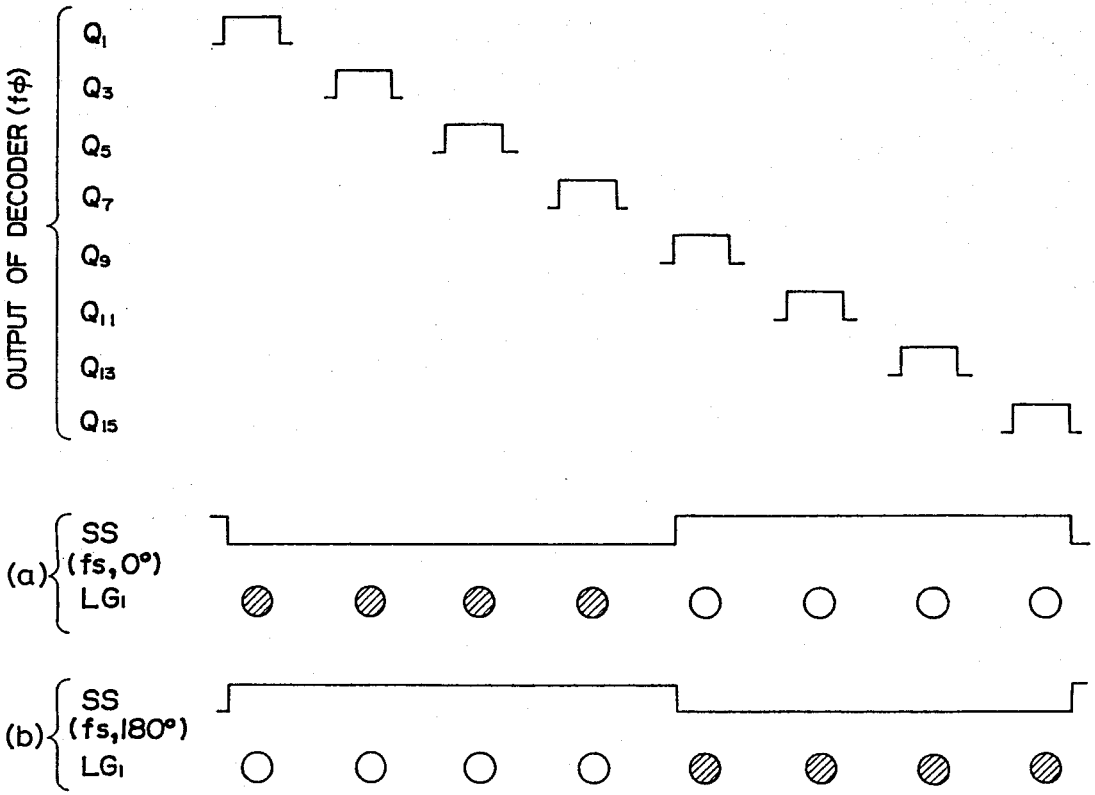

FIG. 9 shows a display operation in the case that the phase of the input tone frequency fs is $\frac{1}{8}$ of the scanning frequency $f\phi$, wherein when the decoder outputs $Q_1, Q_3, Q_5, Q_7$ take a high level respectively and correspondingly the tone signal SS takes a low level, four elements of eight luminous elements are turned on as shown in FIG. 9(*a*). Further, when as shown in FIG. 9(*b*) the phase of the tone signal SS is shifted by 180° compared to the case as shown in FIG. 9(*a*), four elements of eight luminous elements are trurnd on in a turned-on position different from the case as shown in FIG. 9(*a*).

Figure 10:
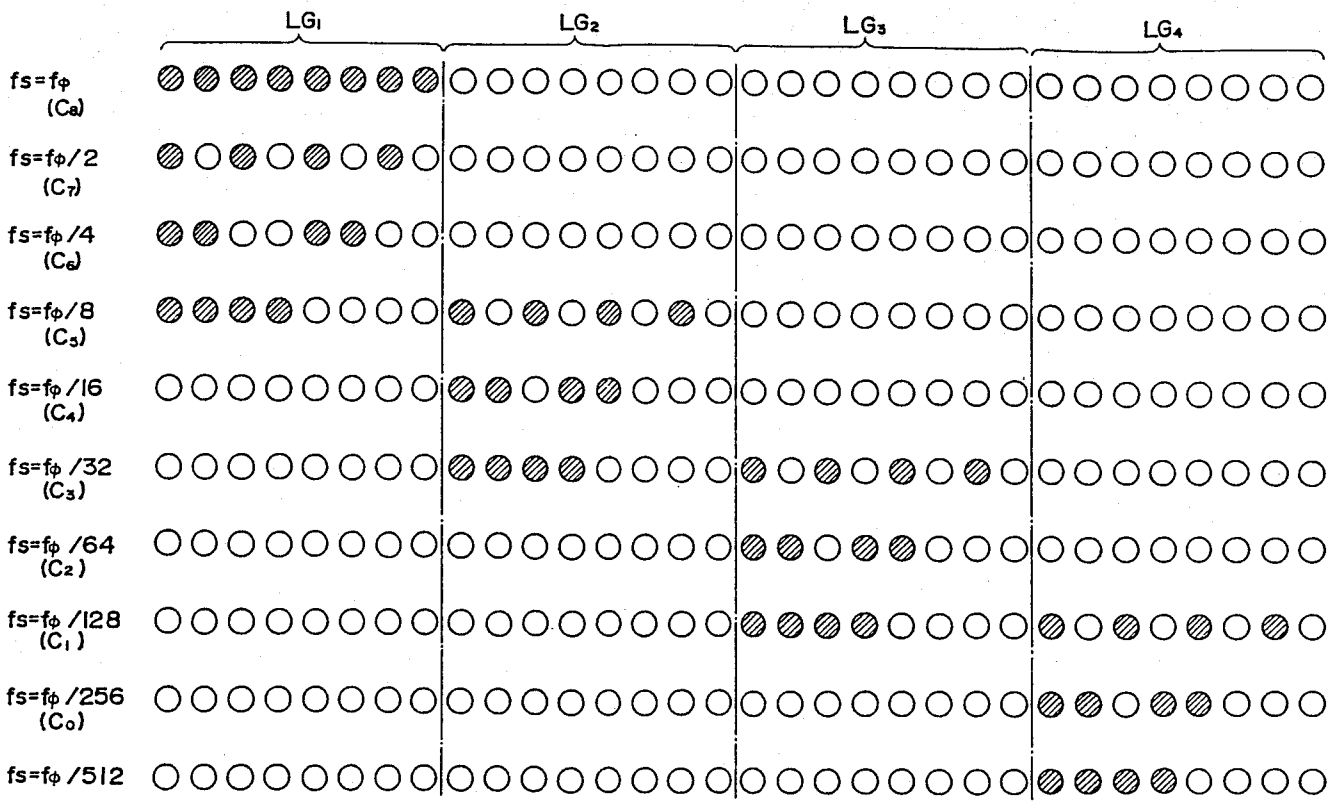
FIG. 10 is a diagram illustrating an example of a display pattern corresponding to various input tone frequencies.

FIG. 10 exemplifies luminous patterns of the groups of luminous elements $LG_1 \sim LG_4$ displayed when the input tone frequency fs takes each value of 1/1, $\frac{1}{2}$, $\frac{1}{4}$, $\frac{1}{8}$, 1/16, 1/32, 1/64, 1/128, 1/256, 1/512 of the scanning frequency of $f\phi$ and in this figure, also, a hatched circle-mark shows a turned-on luminous element and a non-hatched circle-mark shows a turned-off luminous element.

Although a display operation of the group of luminous elements $LG_1$ in the case of $fs = f\phi \sim f\phi/8$ was mentioned above, a display operation which is similar to the case of $fs=f\phi/2\sim f\phi/8$ is carried out for the case of $fs=f\phi/8\sim f\phi/32$ by the group of luminous elements $LG_2$, for the case of $fs=f\phi/32\sim f\phi/128$ by the group of luminous elements $LG_3$ and for the case of $fs=f\phi/128\sim f\phi/512$ by the group of the luminous elements $LG_4$.

If the scanning frequency fs is assumed to correspond to $C_8$ tone, $f\phi/2\sim f\phi/256$ correspond to $C_7$ tone$\sim C_0$ tone. Therefore, if in FIG. 10 an attention is payed to a display pattern alternately turned on and a display pattern turned on by two elements for each four luminous elements, a tuning can be confirmed concerning $C_0$ tone and $C_1$ tone in the group of luminous elements $LG_4$, concerning $C_2$ tone and $C_3$ tone in the group of luminous elements $LG_3$, concerning $C_4$ tone and $C_5$ tone in the group of luminous elements $LG_2$ and concerning $C_6$ tone and $C_7$ tone in the group of luminous elements $LG_1$. In other words, it is possible by four groups of luminous elements to display an agreement of an input frequency with the scanning frequency for eight different octaves of a tone, so that the number of the group of luminous elements can be reduced to a half compared to the case that an agreement of frequency is displayed for each octave.

When an input frequency fs is shifted to a higher direction from a reference frequency, for example, $f\phi/2$, it means that the period of the tone signal SS is shorten in FIG. 7(*a*) so that the display pattern is displaced from right to left at a speed proportional to the degree of the shift and when shifted to a lower direction, the display pattern is displaced from left to right at a speed proportional to the degree of the shift respectively. Therefore, therefrom a direction of the shift and a degree of the shift can be known. Anyway, if the arrangement of the groups of luminous elements is reversed from the above-mentioned, the above-mentioned direction of displacement can be reversed.

Use of tuning apparatus

In the case of using the above-mentioned tuning apparatus, the kind of the scale which is desired for tuning is selected by a scale selecting switch ETS or JIS beforehand. Furthermore, according to the necessity by manipulating the switch US or DS of the pitch adjustor 28, the frequency of the reference frequency signal corresponding to the desired tone name is preset adequately. Thereafter, it is sufficient only to input the tone to be tuned through a microphone 10.

When a tone of a musical instrument having a pitch approximate to $C_4$ tone, for examle, is inputted, the arrangement pattern of the luminous elements to be turned on and off as shown in FIG. 10 (two elements turned on for each four elements) is displayed in the group of luminous elements $LG_2$ of the display section corresponding to the tone name C in the display panel, wherein if the input tone frequency is higher the frequency of the tone $C_4$, this pattern is displaced at a speed corresponding to the degree of a shift towards the left and if the input tone frequency is lower than the frequency of the tone $C_4$, this pattern is displaced at a speed corresponding to the degree of a shift towards the right. Then, it is sufficient for a player to adjust the pitch of a musical instrument tone such that the above-mentioned pattern displacement will be made stationally.

Anyway, without limiting the number of tones to be inputted through a microphone 10 to only one tone, tones of a plurality of musical instruments composing, for example, a band may be inputted simultaneously. When a plurality of tones are inputted in such a way simultaneously, the above-mentioned display is executed in the display section corresponding to each tone name.

Furthermore, the desired turned-on pattern can not be displayed sometimes depending on the phase of the input tone signal such as an example as shown in FIG. 7(*c*) and in this case it is sufficient to re-input the musical instrument tone.

What is claimed is:

1. An electronic tuning apparatus comprising:

(a) input means for inputting a tone signal to be measured;

(b) signal generating means for generating a plurality of reference frequency signals, respectively, corresponding to a plurality of predetermined tone names independently for each tone;

(C) a plurality of groups of luminous elements, respectively, corresponding to said plurality of tone names;

(d) a plurality of display control means arranged, respectively, corresponding to said plurality of tone names; and in which each of said display control means drives the group of luminous elements corresponding to said tone name on the basis of the reference frequency signal of the corresponding tone name from said signal generating means and the input tone signal from said input means, and an on-off arrangement pattern composed of turned-on luminous elements and turned-off luminous elements is differently displayed in the group of luminous elements corresponding to said tone name between the case of the agreement of the frequency of said input tone signal with the frequency of said tone name at a certain octave and the case of the agreement with the frequency of said tone name at another octave.

2. An electronic tuning apparatus according to claim 1, further comprising scale selecting means, and in which said signal generating means generates the reference frequency signal having the frequency corresponding to each of said tone name according to the scale selected by said scale selecting means.

3. An electronic tuning apparatus according to claim 2, in which said scale selecting means include change-over switch means for selecting at least an equal temperament scale and a just intonation scale.

4. An electronic tuning apparatus according to claim 1, further comprising pitch adjusting means, and in which said signal generating means controls the pitch of the reference frequency signal to be generated from said signal generating means independently for each tone name by manipulating said pitch adjusting means.

5. An electronic tuning apparatus according to claim 1, in which said signal generating means include twelve tone generators generating twelve reference frequency signals, respectively, corresponding to twelve tone names.

6. An electronic tuning apparatus according to claim 5, in which each of said plurality of display means of each tone name includes eight luminous elements;

each of said plurality of display control means includes four hexadecimal counters of a first, second, third and fourth and four decoders of a first, second, third and fourth, respectively, connected to each output side of said four hexadecimal counters;

each anode of said eight luminous elements is connected to each output side of said four decoders;

said first hexadecimal counter for each tone name is connected to corresponding each of said twelve tone generators;

said second hexadecimal counter is connected to said first hexadecimal counter so that a frequency divided output, having a frequency of ¼ of the reference frequency signal inputted to said first hexadecimal counter, is inputted;

said third hexadecimal counter is connected to said second hexadecimal counter so that a frequency divided output, having a frequency of 1/16 of said reference fequency signal, is inputted;

said fourth hexadecimal counter is connected to said third hexadecimal counter so that a frequency divided output, having a frequency of 1/64 of said reference frequency signal, is inputted; and each cathode of said eight luminous elements is connected to said input means so that the tone signal to be measured may be inputted to said each cathode, each of said luminous elements is turned on only when a high level signal is inputted to its anode side and a low level signal is inputted to its cathode side.

7. An electronic tuning apparatus according to claim 1, in which said plurality of groups of luminous elements is arranged in a line.

8. An electronic tuning apparatus according to claim 1, in which said plurality of groups of luminous elements is arranged parallelly for each group.

9. An electronic tuning apparatus comprising:

input means for inputting a tone signal to be measured;

signal generating means for generating a plurality of reference frequency signals, respectively, corresponding to a plurality of predetermined tone names independently for each tone;

a plurality of display means, respectively, corresponding to said plurality of tone names;

a plurality of display control means arranged, respectively, corresponding to said plurality of tone names;

scale selecting means; and in which each of said display control means is constructed to display an agreement of the frequency of said tone name at a predetermined octave with the frequency of said input tone signal in the display means corresponding to said tone name on the basis of the reference frequency signal of the corresponding tone name from said signal generating means and the input tone signal from said input means; and said signal generating means generates the reference frequency having the frequency corresponding to each of said tone name according to the scale selected by said scale selecting means.

10. An electronic tuning apparatus according to claim 9, in which said scale selecting means include changeover switch means for selecting at least an equal temperament scale and a just intonation scale.

11. An electronic tuning apparatus comprising:

input means for inputting a tone signal to be measured;

signal generating means for generating a plurality of reference frequency signals, respectively, corresponding to a plurality of predetermined tone names independently for each tone;

a plurality of display means, respectively, corresponding to said plurality of tone names;

a plurality of display control means arranged, respectively, corresponding to said plurality of tone names;

pitch adjusting means; and in which each of said display control means is constructed to display an agreement of the frequency of said tone name at a predetermined octave with the frequency of said input tone signal in the display means corresponding to said tone name on the basis of the reference frequency signal of the corresponding tone name from said signal generating means and the input tone signal from said input means; and said signal generating means controls the pitch of the reference frequency signal to be generated from said signal generating means independently for each tone name by manipulating said pitch adjusting means.

12. An electronic tuning apparatus comprising:

input means for inputting a tone signal to be measured;

signal generating means for generating a plurality of reference frequency signals, respectively, corresponding to a plurality of predetermined tone names independently for each tone;

a plurality of display means, respectively, corresponding to said plurality of tone names;

a plurality of display control means arranged, respectively, corresponding to said plurality of tone names; and in which each of said display control means is constructed to display an agreement of the frequency of said tone name at a predetermined octave with the frequency of said input tone signal in the display means corresponding to said tone name on the basis of the reference frequency signal of the corresponding tone name from said signal generating means and the input tone signal from said input means;

said signal generating means includes twelve tone generators generating twelve reference frequency signals, respectively, corresponding to twelve tone names;

each of said plurality of display means of each tone name includes eight luminous elements;

each of said plurality of display control means includes four hexadecimal counters of a first, second, third and fourth and four decoders of a first, second, third and fourth, respectively, connected to each output side of said four hexidecimal counters;

each anode of said eight luminous elements is connected to each output side of said four decoders;

said first hexadecimal counter for each tone name is connected to corresponding each of said twelve tone generators;

said second hexadecimal counter is connected to said first hexadecimal counter so that a frequency divided output, having a frequency of ¼ of the reference frequency signal inputted to said first hexadecimal counter is inputted;

said third hexadecimal counter is connected to said second hexadecimal counter so that a frequency divided output, having a frequency of 1/16 of said reference frequency signal, is inputted;

said fourth hexadecimal counter is connected to said third hexadecimal counter so that a frequency divided output, having a frequency of 1/64 of said reference frequency signal, is inputted; and each cathode of said eight luminous elements is connected to said input means so that the tone signal to be measured may be inputted to said each cathode, each of said luminous elements is turned on only when a high level signal is inputted to its anode side and a low level signal is inputted to its cathode side.

13. An electronic tuning apparatus according to claim 12, in which each eight luminous elements, respectively, connected to said first, second, third and fourth decoders are arranged in a line.

14. An electronic tuning apparatus according to claim 12, in which each eight luminous elements, respectively, connected to said first, second, third and fourth decoders are arranged parallelly for each said decoder.

* * * * *